US011849800B2

(12) United States Patent
Mason

(10) Patent No.: US 11,849,800 B2
(45) **Date of Patent: *Dec. 26, 2023**

(54) SOLE FOR A SPORT FOOTWEAR, A WORK FOOTWEAR OR A FOOTWEAR FOR THE LEISURE TIME

(71) Applicant: LTWHP, LLC, Wilmington, DE (US)

(72) Inventor: Angelo Mason, Caerano di San Marco (IT)

(73) Assignee: LTWHP, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/147,346

(22) Filed: Dec. 28, 2022

(65) Prior Publication Data

US 2023/0225451 A1 Jul. 20, 2023

Related U.S. Application Data

(63) Continuation of application No. 16/881,153, filed on May 22, 2020, now Pat. No. 11,571,038.

(30) Foreign Application Priority Data

May 23, 2019 (EP) ..... 19176073

(51) Int. Cl.
*A43B 13/18* (2006.01)
*A43B 7/1455* (2022.01)
*A43B 13/22* (2006.01)

(52) U.S. Cl.
CPC ..... *A43B 13/18* (2013.01); *A43B 7/146* (2013.01); *A43B 13/226* (2013.01)

(58) Field of Classification Search
CPC ..... A43B 13/18; A43B 13/181; A43B 13/223; A43B 13/226; A43B 7/146
USPC ..... 36/28, 141
See application file for complete search history.

(56) References Cited

U.S. PATENT DOCUMENTS 2,833,057 A * 5/1958 Hack ..... A43B 13/184 D2/960
2,930,149 A * 3/1960 Hack ..... A43B 13/181 D2/960
3,079,707 A * 3/1963 Hack ..... A43B 13/181 36/28
3,087,261 A * 4/1963 Russell ..... A43B 13/181 D2/960
3,087,262 A * 4/1963 Russell ..... A43B 13/181 36/28
4,934,070 A * 6/1990 Mauger ..... A43B 17/035 36/43
5,189,816 A * 3/1993 Shibata ..... A43B 17/026 36/43
5,365,678 A * 11/1994 Shibata ..... A43B 13/20 36/43
5,839,208 A * 11/1998 Huang ..... A43B 13/20 36/28
6,367,174 B1 * 4/2002 Shibata ..... A43B 7/146 36/141
11,571,038 B2 * 2/2023 Mason ..... A43B 13/226

(Continued)

*Primary Examiner* — Marie D Bays

(57) ABSTRACT

The present invention regards a sole for a sport shoe, work shoe or leisure shoe including a main body having a lower layer delimiting a surface, lower during use, set to come into contact with the ground and an upper layer set to come into contact with a foot of a user or to support from the bottom, during use, an insole.

17 Claims, 6 Drawing Sheets

(56) References Cited

U.S. PATENT DOCUMENTS

| | | | | |
|---|---|---|---|---|
| 2004/0237343 | A1* | 12/2004 | Herman | A43B 13/141 36/28 |
| 2011/0167672 | A1* | 7/2011 | Bond | A43B 13/223 36/28 |
| 2011/0308106 | A1* | 12/2011 | Lim | A43B 7/1445 36/28 |
| 2012/0005921 | A1* | 1/2012 | Diepenbrock | A43B 3/0042 36/43 |
| 2013/0000157 | A1* | 1/2013 | Wu | A43B 13/12 36/30 A |
| 2016/0219974 | A1* | 8/2016 | Izquieta Anaut | B29D 35/122 |
| 2020/0085139 | A1* | 3/2020 | Izquieta Anaut | A43B 13/181 |

* cited by examiner

SOLE FOR A SPORT FOOTWEAR, A WORK FOOTWEAR OR A FOOTWEAR FOR THE LEISURE TIME

CLAIM OF PRIORITY/CROSS-REFERENCE TO RELATED APPLICATION

The present application is a Continuation Patent Application of currently-pending U.S. patent application Ser. No. 16/881,153 filed on May 22, 2020, which has a foreign claim of priority to European Patent Application No. EP 19176073.5 filed on May 23, 2019.

The contents of both of the above-referenced patent applications, namely, U.S. patent application Ser. No. 16/881,153 filed on May 22, 2020 and European Patent Application No. EP 19176073.5 filed on May 23, 2019, are incorporated herein in their entirety by reference.

FIELD OF THE INVENTION

The present invention regards a sole for sport shoes, if desired running shoes, or work shoes or leisure shoes, as well as a shoe including one such sole.

BACKGROUND OF THE INVENTION

Running, as an activity carried out for personal pleasure, but above all for races, is carried out by using shoes such to ensure good elastic return each time the user raises his/her foot with the respective shoe from the ground after a step of bending the latter.

The international application published at number WO2018167331A1, regards for example a sole for shoes with a lower layer, a lateral wall which is extended from the perimeter of such layer as well as a series of protuberances which are projected upward starting from the lower layer.

Each protuberance is extended transverse to the longitudinal axis of the sole and comprises a first segment in contact with the lower layer and a second segment distal from the lower layer with respect to the first segment and bent relative to the latter.

Between the lateral ends of each protuberance and the lateral wall, there is a first separation, which allows the complete bending of each protuberance, while between two contiguous protuberances there is a second separation, in a manner such that when the protuberances are bent by the support of the foot of a user, the second segment abuts against a contiguous protuberance.

In addition, in the front part of the sole the second segments are tilted so as to be directed towards the front end of the sole, while in the rear part the second segments are tilted so as to be directed towards the rear part of the sole.

It was possible to verify that one such solution does not ensure a good forward thrust for a user, in particular as a function of the shape of the protuberances.

SUMMARY OF THE INVENTION

One object of the present invention is to provide a new sole for sport shoes, if desired running shoes, or work shoes or leisure shoes.

Another object of the present invention is to provide a new sole as stated above which ensures an optimal thrust forward during use.

Another object of the present invention is to provide a sole capable of being ergonomically adapted to the foot of each user.

Another object of the present invention is to provide a sole which, in addition to that indicated above, ensures a good channeling of the sweat.

In accordance with one aspect of the invention, a sole is provided according to the present application.

The present application refers to preferred or advantageous embodiments of the invention.

These and other objects, features and advantages of the present invention will become more apparent when the drawings as well as the detailed description are taken into consideration.

BRIEF DESCRIPTION OF THE DRAWINGS

Other characteristics and advantages of the invention will be more evident from the description of embodiments of a sole, illustrated by way of example in the enclosed drawings in which.

In the enclosed set of drawings, equivalent components or parts are marked with the same reference numbers.

DETAILED DESCRIPTION OF THE INVENTION

Figure 1:
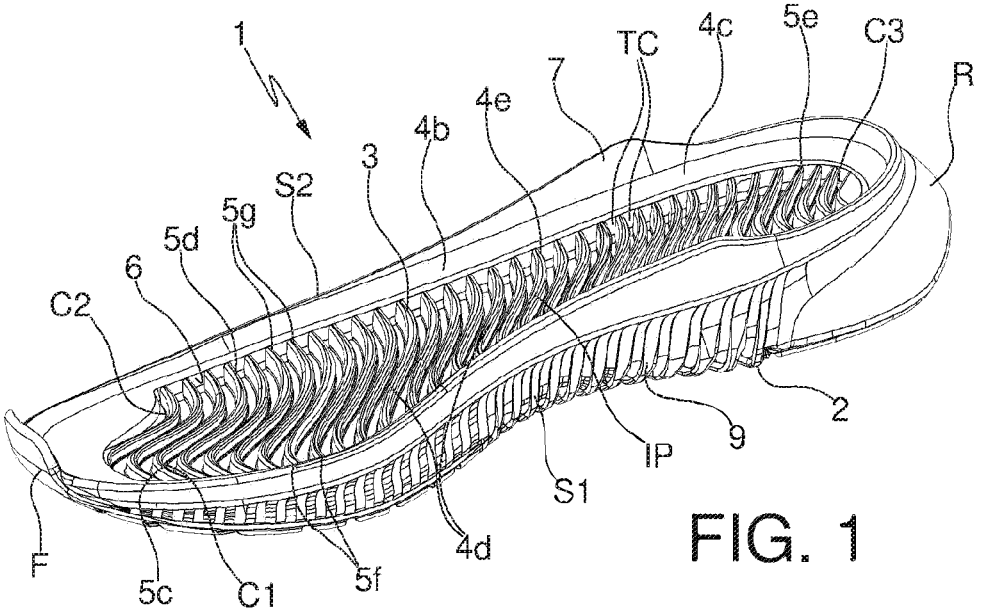
FIGS. 1 and 2 are perspective views of a sole according to the present invention.
Figure 2:
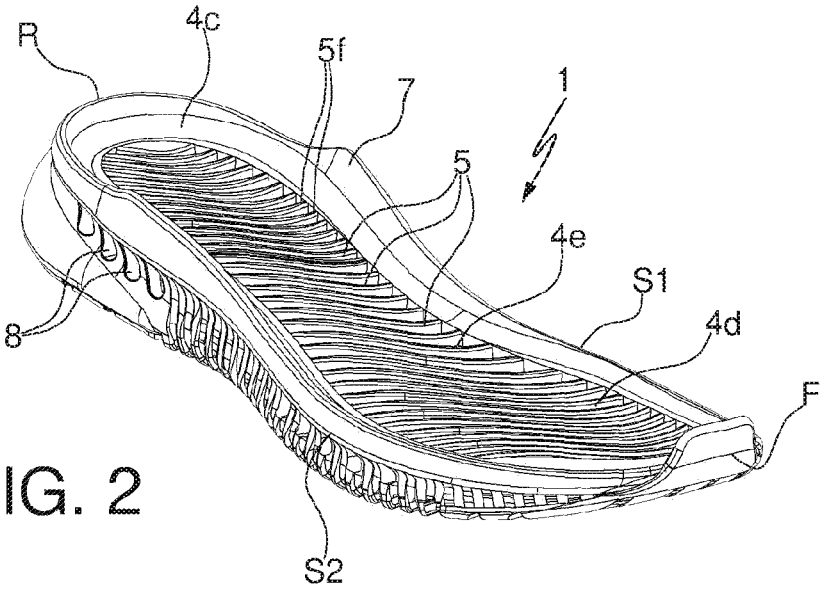
Figure 3:
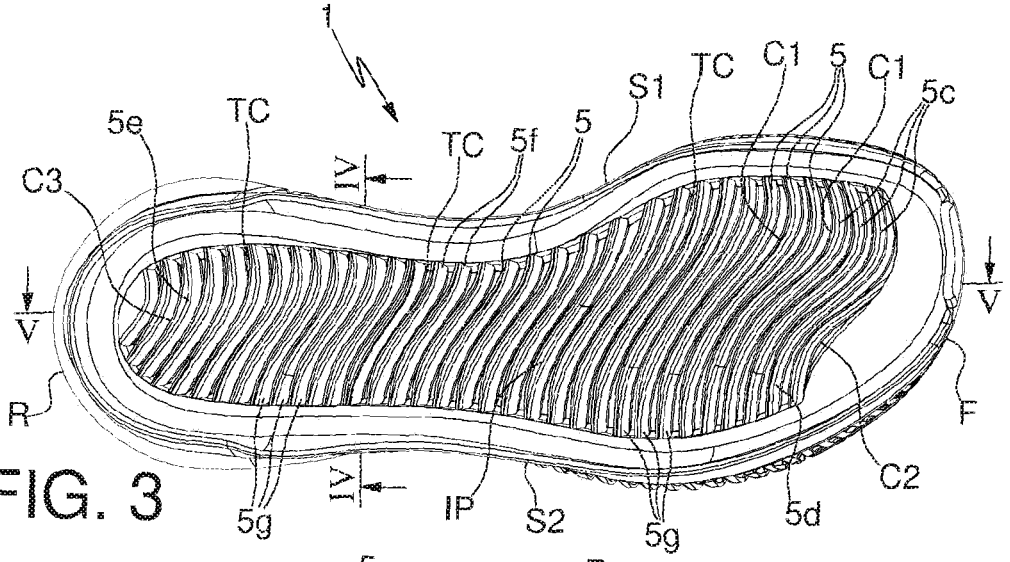
FIG. 3 is a top view of the sole of FIG. 1.
Figure 4:
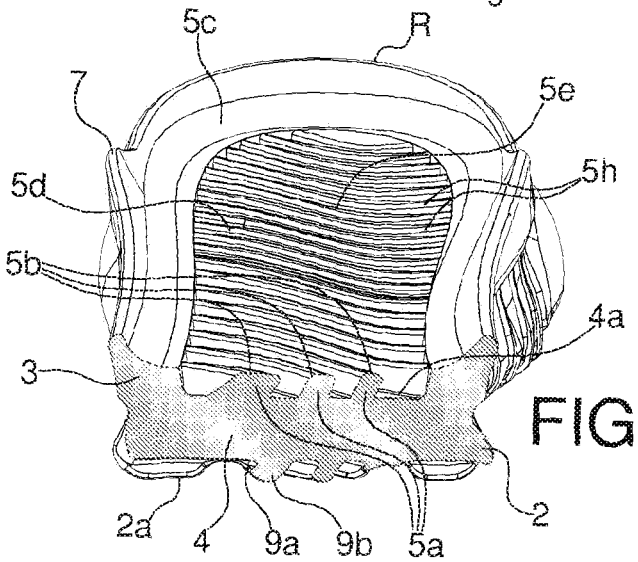
FIG. 4 is a sectional view according to line IV-IV of FIG. 3.
Figure 5:
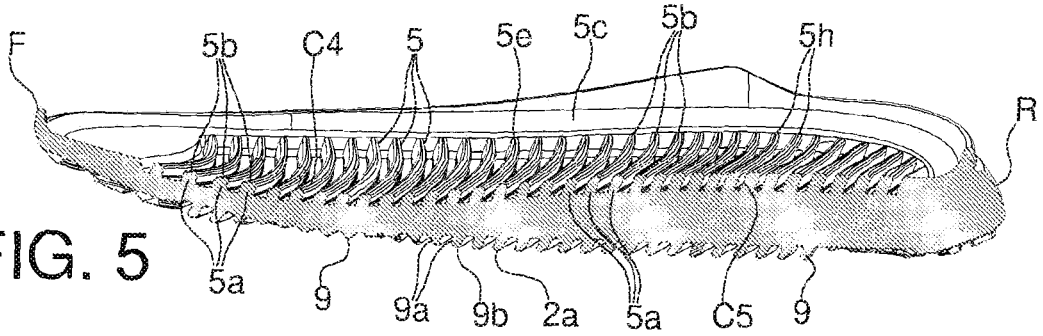
FIG. 5 is a sectional view according to line V-V of FIG. 3, FIGS. 6 to 8 are respectively views from the bottom, from one side and from the other side of the sole of FIG. 1, FIGS. 9 and 10 are perspective views of another sole embodiment according to the present invention.
Figure 6:
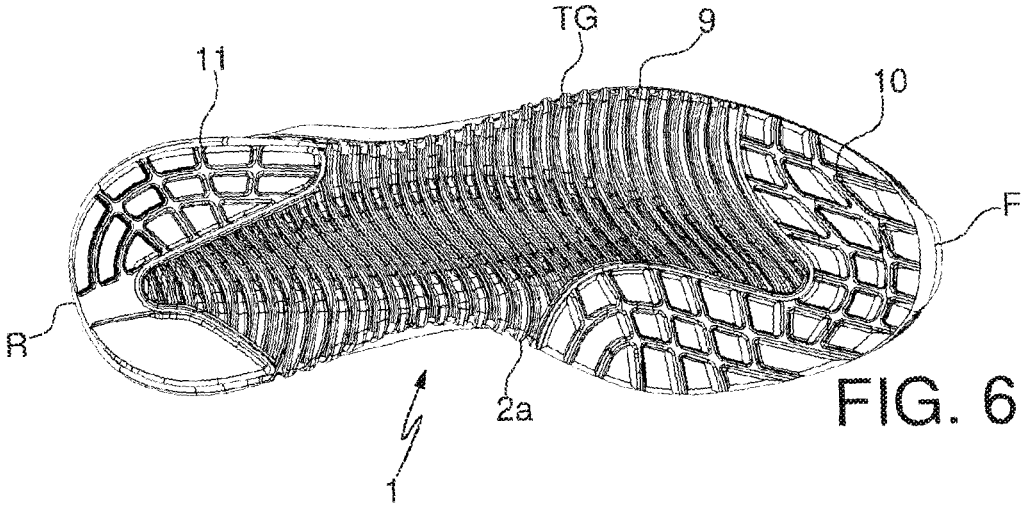
Figure 7:
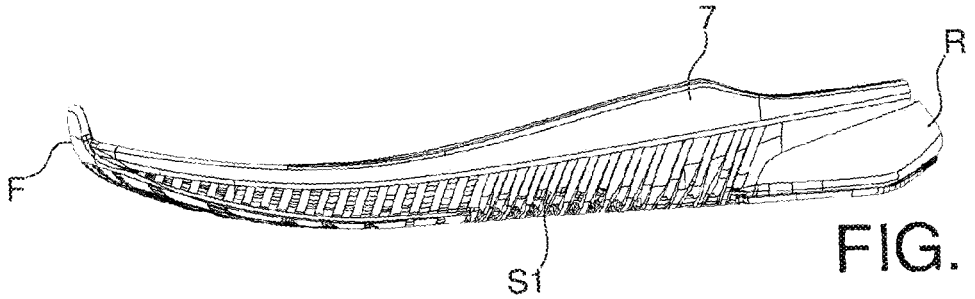
Figure 8:
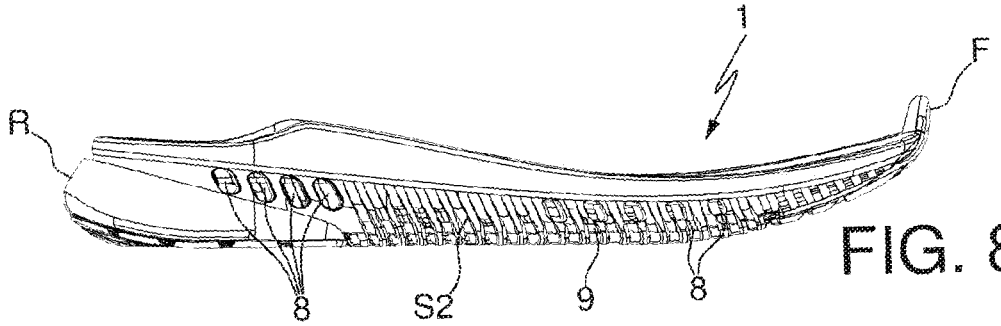

With reference to FIGS. 1 to 8, a sole 1 is illustrated according to the present invention for a sport shoe, if desired running shoe, or work shoe or leisure shoe; such sole comprises a main body having a lower layer 2 delimiting a surface, lower during use 2a, set to come into contact with the ground and an upper layer 3 set to come into contact with a foot of a user or to support, during use, an insole (not illustrated in the figures) from the bottom.

The main body can be made of a single sheet 4 or of multiple sheets that are superimposed, constrained to each other by means of over-printing or adhesive or glue or any other suitable method. If the main body is made of a single sheet 4, then the lower layer 2 and the upper layer are made of a single piece.

The sole 1 naturally comprises a front F, a back R and two sides S1, S2, i.e. a medial or interior side S1 and a lateral or exterior side S2.

The upper layer 3 then comprises a respective sheet or a top section of a sheet 4 from a surface, upper during use 4a thereof a plurality of protuberances 5 project upward with a trim tilted with respect to the vertical or to the direction from the lower surface 2*a* to the upper surface 4*a*.

The protuberances 5 have a constraining base 5*a* and a free end 5*b*, such to have each free end 5*b* closer to the back R of the sole 1 with respect to the relative constraining base 5*a*. In substance, the protuberances 5 are tilted backward or with free end backward, i.e. each protuberance 5 in the passage from the constraining base 5*a* to the free end 5*b* is extended in the direction of the back and only in the direction of the back in a continuous or constant manner.

The protuberances 5 have a wall or rib configuration, hence with a single external edge defining the free end 5*b*, i.e. the protuberances no longer have free ends or bifurcations.

The protuberances 5 can be provided in each zone of the sole, i.e. in a zone close to the front F and distal from the back R of the sole, in a zone close to the back R and distal from the front F of the sole and in a zone at the shoe waist IP, or only in a zone close to the front F and distal from the back R of the sole, and in a zone close to the back R and distal from the front F of the sole 1, or only in a zone close to the front F and distal from the back R of the sole, or only in a zone close to the back R and distal from the front F of the sole.

Preferably, the protuberances 5 are provided both in a zone close to the front F and distal from the back R of the sole 1 and in a zone close to the back R and distal from the front F of the sole 1 and, if desired, also in a zone at the shoe waist IP.

If desired, pairs of protuberances 5, contiguous or adjacent and successive, together delimit a respective transverse channel TC, e.g. of about 1-20 mm. The transverse channel TC is delimited preferably for the entire transverse extension or from one side of the protuberances 5 to the other, i.e. pairs of protuberances, contiguous or adjacent and successive, do not touch, at least in rest trim, for the entire transverse extension thereof.

In addition, the protuberances 5 are elastically pliable in a manner such that by applying a pressure thereon, in particular by the foot of a user, each protuberance 5 is bent such that the respective free end 5*b* approaches or if desired comes into contact with the protuberance 5 that is rear with respect thereto or closer to the back R, so as to obtain a deformed condition or trim, while when the pressure is interrupted or decreased, for example when a user raises a foot in engagement with the sole or with the respective shoe during running or walking, the protuberances tend to return into the initial position, such that the respective free end 5*b* returns in the direction of the front F, releasing a forward thrust force or force in the direction of the front F of the sole to a respective user, newly obtaining a rest or non-deformed trim or condition.

Preferably, protuberances 5 with free end 5*b* closer to the front F with respect to the relative constraining base 5*a* are not provided. Clearly, protuberances 5 thus arranged could also be provided, although in a percentage lower than 5-10% of the total number of protuberances 5.

If a protuberance or multiple protuberances 5 instead has/have a free end thus structured, such protuberance 5 or protuberances 5 after a bending step would provide, once the pressure thereon is interrupted, a backward thrust force or force in the direction of the back R, which is clearly not desired.

The protuberances 5 can have tilt with respect to a vertical.

On such matter, considering the sole with the respective surface, lower during use 2a, abutted against a horizontal surface and in rest or non-deformed trim or condition, the protuberances 5 can be tilted with respect to the vertical, in a section plane defined or in which the vertical and the direction from the front F to the back R (see FIG. 5) lie and, if desired, also in a section plane defined or in which the vertical and the direction from one side S1 to the other S2 (see FIG. 4) lie.

More particularly, in a section plane defined or in which the vertical and the direction from one side S1 to the other S2 lie, the protuberances 5 can be tilted with respect to the vertical between 5° and 45°.

In a section plane defined or in which the vertical and the direction from the front F to the back R (see FIG. 5) lie, the protuberances 5 can instead be tilted with respect to the vertical between 5° and 30°, with the free end 5*b* closer to the back R with respect to the relative constraining base 5*a*.

The tilt with respect to the vertical in the aforesaid planes of each protuberance 5 can vary, preferably remaining in the above-indicated intervals, from one side S1 to the other side S2.

Moreover, the tilt of each protuberance 5 can be different from those of the other protuberances 5.

In addition, the protuberances 5 are advantageously tilted for the entire respective extension between constraining base 5*a* and free end 5*b* and for the entire respective transverse extension or from one side S1 to the other S2.

If desired, the protuberances 5 have curved progression in a direction from one side S1 to the other S2 or in a direction transverse to the longitudinal extension or length of the sole 1.

On such matter, the protuberances 5 at the front F and/or at the shoe waist IP of the sole each comprise, in the direction from the interior or medial part S1 to the exterior or lateral part S2 of the sole 1, a first curved section 5*c* defining a first concavity C1 open towards the back R of the sole and then a second curved section 5*d* defining a second concavity C2 open towards the front F of the sole 1.

The protuberances 5 at the shoe waist IP and/or of the back R of the sole 1 can instead each comprise, in the direction from the internal or medial side S1 to the external or lateral side S2 of the sole, only one third curved section 5*e* defining a third concavity C3 open towards the back R of the sole.

On such matter, if the protuberances 5 have curved progression, the condition according to which the protuberances 5 have free end 5*b* closer to the back R of the sole 1 with respect to the relative constraining base 5*a* refers to each transverse section of the protuberances, i.e. a free end 5*b* is closer to the back R relative to the respective constraining base 5*a*, i.e. relative to the constraining base 5*a* from which such free end 5*b* is extended.

With reference to such aspect, the free end 5*b* of a first side 5*f* of a protuberance 5 at the medial side S1 could be closer to the front with respect to the constraining base 5*a* of the free end 5*b* of a second side 5*g* of a protuberance 5 at the lateral side S2, but the free end Sb of a first side 5*f* of a protuberance 5 at the medial side S1 is closer to the back with respect to the constraining base 5*a* of the free end 5*b* of such first side 5*f* and the same holds true for the free end 5*b* and the constraining base of a second side 5*g* of a protuberance 5 at the lateral side S2.

In substance, for each transverse section the protuberances 5 have free end 5*b* closer to the back R of the sole 1 with respect to the constraining base 5*a*, but this is not necessarily true for the free end 5*b* of a section of a protuberance 5 and for the constraining base 5*a* of another section of the same protuberance 5.

Then, with regard to the height of the protuberances 5, this could be between about 1 mm and 3 cm.

Naturally, the protuberances 5 could have height different from each other, for example lower height, e.g. between 1 and 20 mm at the front F and/or at the shoe waist IP and greater height, e.g. between 10 and 30 mm at the back R. Naturally, the height of a rib 5 can also vary from one end 5*f* to the other 5*f*.

Preferably, each protuberance 5 has a first side or terminal end 5*f* at the interior or medial part closer to the front of the sole with respect to the other or second side or terminal end 5*g* at the exterior or lateral part of the sole 1. On such matter, the first terminal end 5*f* can be closer to the front F with respect to the second terminal end 5*g* between about 10 mm and 3 cm.

Such distance or difference can vary in accordance with the position of the protuberances 5 and be greater, for example between 1 and 3 cm, for the protuberances 5 at the front F or at the shoe waist IP and instead be smaller for the protuberances 5 at the back R, e.g. between 10 mm and 1 cm.

The protuberances 5 can have a thickness between 2 mm and 1 cm.

Clearly, the thickness of the protuberances 5 can be constant from the constraining base 5*a* to the free end 5*b* or tapered, hence with free end 5*b* that is thinner than the respective base 5*a*.

Advantageously, the terminal or top bands or faces 5*h* of the free ends 5*b* of the protuberances 5 are substantially aligned along a surface 4*e* which from the front F to the back R has a fourth concavity C4 directed upward and then a fifth concavity CS directed downward.

Due to such characteristic, the abutment surface 4*e* for the foot of a user or for an insole ensures suitable comfort.

The protuberances 5 are distributed for 50-95%, if desired 60-80% of the longitudinal extension or back R-front F extension of the sole 1 and for 50-95%, if desired 60-85% of the transverse extension or from one side S1 to the other S2 of the sole.

On such matter, the sole 1 or better yet the respective sheet or the respective top section of a sheet 4 can define a recessed zone 6 open upward and extended for 50-95% of the longitudinal extension or back R-front F extension of the sole 1 and for 50-95% of the transverse extension or from one side S1 to the other S2 of the sole. The bottom of the recessed zone 6 can be defined by the surface, upper during use 4a.

The recessed zone 6 can have a depth substantially corresponding to the height of the protuberances 5 and variable from the front F to the back R and from one side to the other as a function of such height.

If a recessed zone 6 is provided, the protuberances 5 are distributed for the entire longitudinal extension of the recessed zone 6 and are each extended from one section of the edge portion 4*b* of the sheet or respective top section of a sheet 4 of delimitation of the recessed zone 6 on one side S1 of the sole to another section of the edge portion 4*b* of delimitation of the recessed zone 6 on the other side S2 of the sole.

In such case, the protuberances 5 can be embedded or constrained, each at a respective section of the edge portion 4*b* of delimitation of the recessed zone 6, such that the sides or terminal ends 5*f*, 5*g* of the protuberances 5 are substantially fixed in such sections of the edge portion 4*b*.

The edge portion 4*b* in such case is clearly annular or in any case it is extended on a surface closed as a loop of clearly irregular shape.

The sole can then comprise a raised edge 7 which is extended upward starting from the edge portion 4*b* at the front F, back R and/or sides S1, S2 of the sole.

In the case of the presence of a recessed zone 6, then the abutment surface 4*e* would be defined along a peripheral zone 4*c* from the edge portion 4*b* and internally or in an intermediate zone 4*d*, entirely or partly surrounded by the peripheral zone 4*c*, by the protuberances 5 or better yet by the terminal or top bands or faces 5*h* of the free ends 5*b* thereof. Therefore, the intermediate zone 4*d* of the abutment surf ace 4*e* would be discrete and non-continuous.

The peripheral zone 4*c*, if present, is annular so as to be extended for the entire periphery of the abutment surface 4*e* or also an open curved section.

On such matter, still in the case of the presence of a recessed zone 6, then the terminal or top bands or faces 5*h* of the free ends 5*b* of the protuberances 5 are substantially aligned, also with the peripheral zone 4*c* defined by the edge portion 4*b*.

In one or both sides S1, S2, preferably only in the external or lateral side S2, one or more windows 8 can be provided within which a section of a protuberance or the like is visible, such to graphically recall the shape of the protuberances 5.

If desired, the sole 1 has on the bottom or at the surf ace, lower during use 2a, of the ribs 9 with configuration similar to that of the protuberances 5.

Such ribs 9 can be or not be, as a function in particular of the respective height, flexible like the protuberances 5.

If ribs 9 are provided, then these have an attachment base 9*a* and a free tip 9*b*, such to have each free tip 9*b* closer to the front F of the sole 1 with respect to the relative attachment base 9*a*. In substance, the ribs 9 are tilted forward.

Moreover, the ribs 9 have a wall or rib configuration, hence a single external edge defining the free tip 9*b*, i.e. the ribs no have a plurality of free ends or bifurcations.

The ribs 9 can be provided in a zone close to the front F and distal from the back R of the sole, as well as in a zone close to the back R and distal from the front ribs F of the sole 1.

If desired, pairs of ribs 9, contiguous or adjacent and successive, delimit a respective transverse interspace TG, e.g. of about 1-20 mm. The transverse interspace TG is preferably delimited for the entire transverse extension or from one side of the ribs 9 to the other, i.e. pairs of ribs, contiguous or adjacent and successive, do not touch, at least in rest trim, for their entire transverse extension.

In addition, the ribs 9 are elastically pliable in a manner such that by applying a pressure thereon, in particular by the foot of a user, each rib 9 is bent such that the respective free tip 9*b* approaches or if desired comes into contact with the rib 9 to the front thereto or closer to the front, so as to obtain a deformed condition, while when the pressure is interrupted or decreased, for example when a user raises a foot in engagement with the sole or with the respective shoe during running or walking, the ribs 9 tend to return into the initial position, such that the respective free tip 9*b* returns in the direction of the back R, releasing a forward thrust force or force in the direction of the front F of the sole towards a respective user, newly obtaining a rest or non-deformed condition.

Preferably, ribs 9 with free end closer to the back R with respect to the relative attachment base 9*a* are not provided. Clearly, ribs 9 thus arranged could also be provided, although in a percentage lower than 5-10% of the total number of the ribs.

The ribs 9 can also be extended in part on the sides S1, S2 of the sole 1.

Apart from that, that described above with reference to the protuberances 5 can be applied to the ribs 9, if the latter are provided.

If desired, the sole 1 can comprise one or more tread portions 10, 11, which are constrained, e.g. glued or molded on the bottom of the sheet 4 or of the superimposed sheets.

Such tread portions 10, 11 can be glued or molded on the surface, lower during use 2a, for example one 10 at the front F and another 11 at the back R. Such portions 10, 11 can for example be constrained on a section for example substantially smooth on the bottom of the sheets 4 or of the superimposed sheets.

The sole 1 can be made of a material selected from the group constituted by ethylene vinyl acetate (EVA), polyurethane (PU), rubber, expanded or compact thermoplastic polyurethane (TPU), thermoplastic rubber (TR), polyvinyl chloride (PVC) and/or similar polymers.

The sole 1 can be made for example of a single piece, apart from the tread portions 10, 11, if these are provided.

Figure 9:
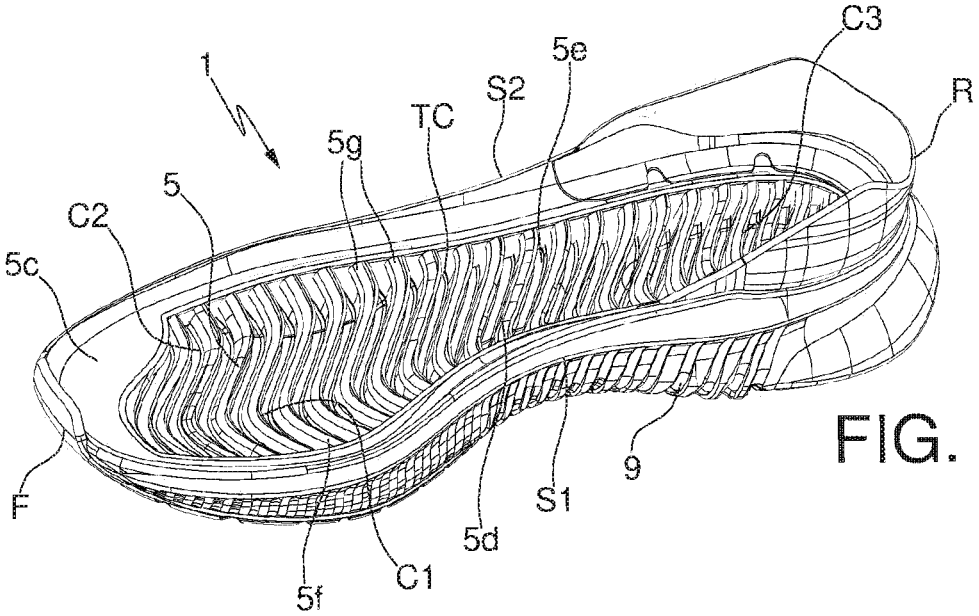
Figure 10:
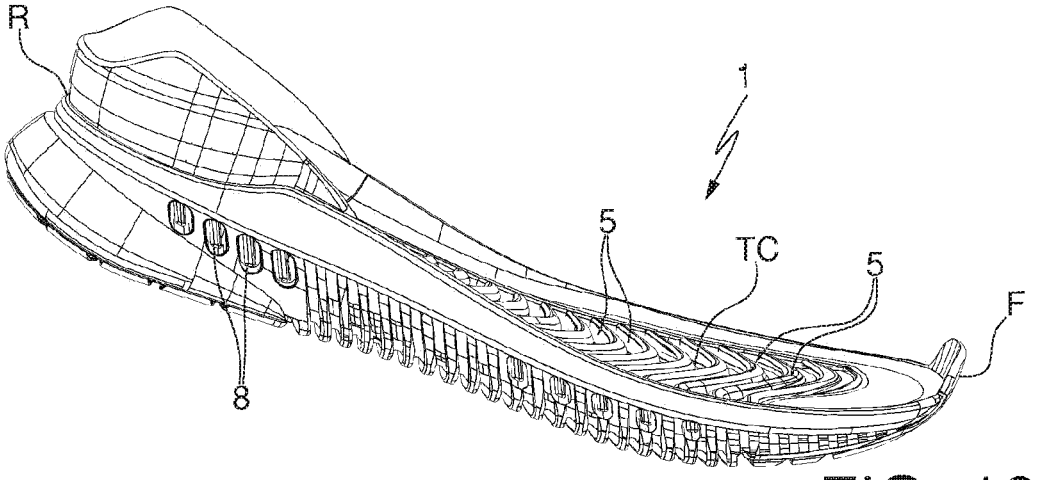
Figure 11:
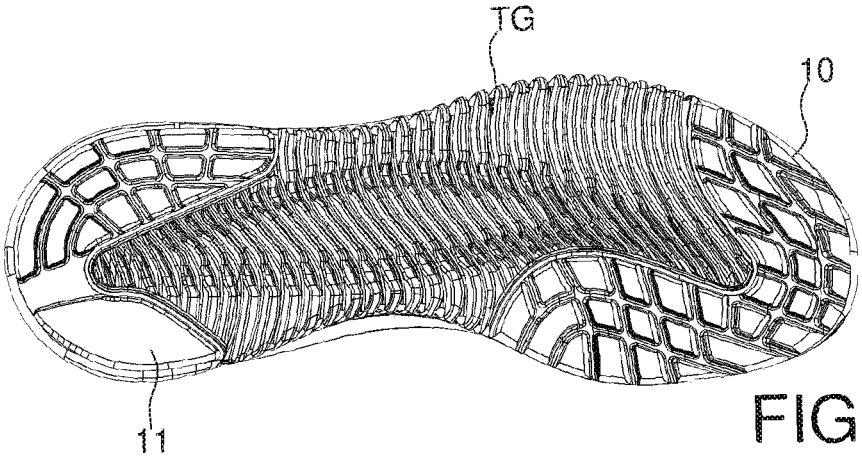
FIGS. 11 to 13 are respectively views from the bottom, from one side and from the other side of the sole of FIG. 9, and FIGS. 14 and 15 are exploded views of the sole of FIG. 9.
Figure 12:
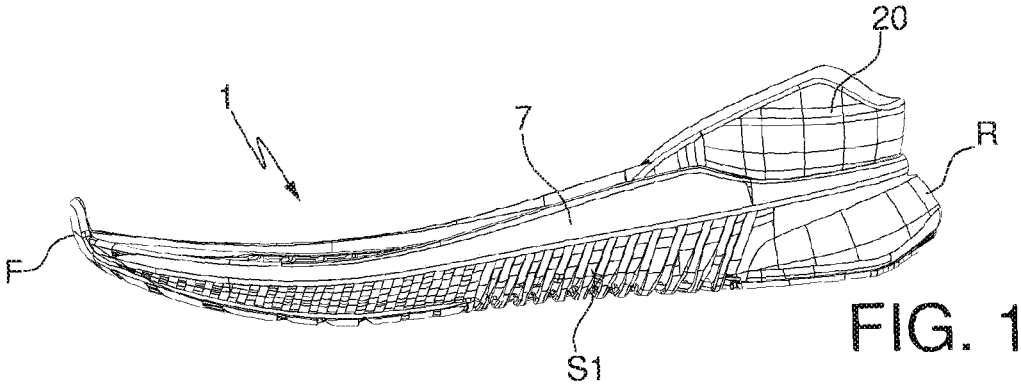
Figure 13:
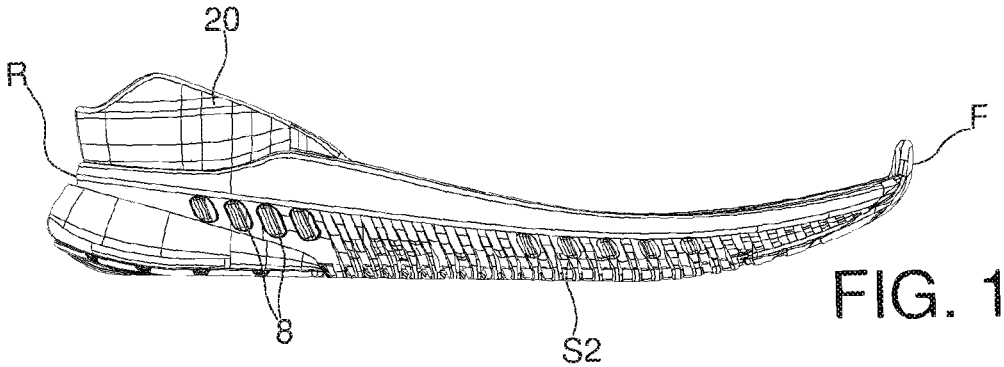
Figure 14:
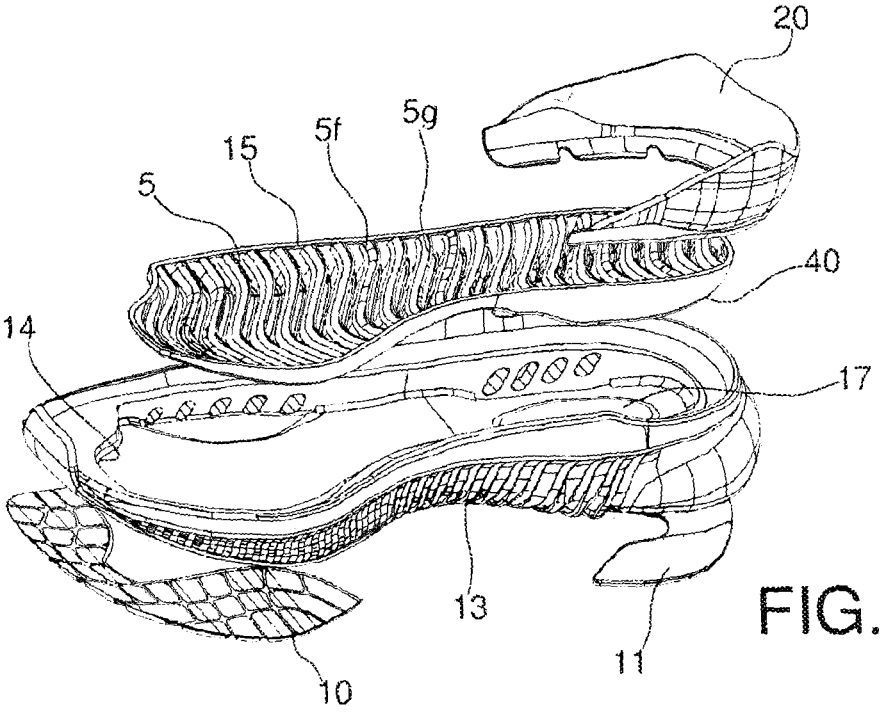
Figure 15:
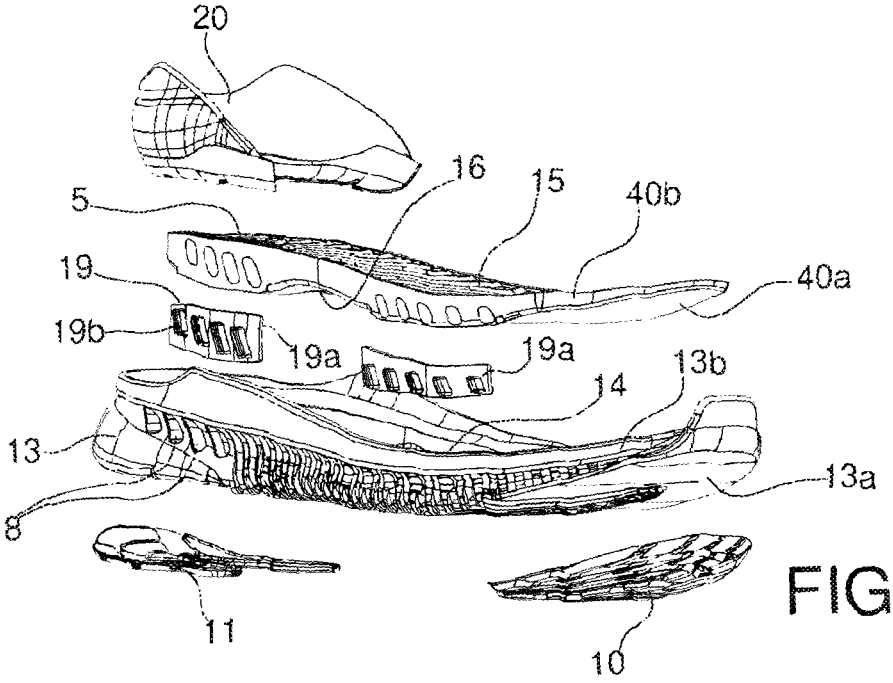

With reference now to the FIGS. 9 to 15, another embodiment according to the present invention is illustrated, in which the sole comprises an external sole component 13 defining a cavity 14 as well as an insert 15 substantially housable to size in the cavity 14, and such insert 15 comprises a sheet 40 as well as the protuberances 5 substantially projecting therefrom as indicated above.

In such case, the lower layer is defined by the external sole component, while the upper layer is defined by the insert 15.

If desired, the insert 15 is removably housed in the cavity 14, even if the insert 15 could also be fixed, if desired by means of glue or with another suitable way in the cavity 14.

The sheet 40 can have a base wall 40*a*, from the edge of which an annular wall 40*b* is projected upward.

The protuberances 5 can in such case preferably each have the first side or terminal end 5*f* and the second side or terminal end 5*g* fixed, embedded or in any case constrained in the annular wall 40*b*.

The insert 15 can be constrained, for example glued within the cavity 14.

In substance, the insert 15 can be attained like the recessed zone described above with reference to FIGS. 1 to 8.

The insert 15 can comprise one or more recessed zones or relief portions 16 engageable to size in a respective projecting or downstream portion 17, for the correct positioning of the insert in the cavity 14.

With regard in detail to the external sole 13, this can have a lower layer 13*a* and a peripheral portion 13*b* projecting upward from the lower layer 13*a*.

Moreover, through windows 8 made in the peripheral portion 13*b* can be provided, in such case, the sole can comprise one or more components 19 for filling the windows 8.

The fill components 19 can have a plate section 19*a* from which blocks 19*b* are extended for filling the windows 8.

The fill components 19 can be housed and compressed between the insert 15, more particularly between a section of the insert 15 and the external sole component 13 or the respective peripheral portion 13*b*.

The fill component(s) 19 can/could be transparent.

The fill component(s) 19 serves to prevent the entrance of dirt into the windows 8, without hiding the bottom of the windows 8.

The sole 1 can also be provided with a heel portion 20, if desired configured substantially as a U; such heel portion 20 can be constrained, for example glued or fixed with other means to the external sole component 13, more particularly to an upper rear section of the latter.

The external sole component 13 and the insert can be made of a material selected from the group constituted by ethylene vinyl acetate (EVA), polyurethane (PU), rubber, expanded or compact thermoplastic polyurethane (TPU), thermoplastic rubber (TR), polyvinyl chloride (PVC) and/or similar polymers.

A sole according to the present invention can then be made in a single piece or of multiple pieces that are suitably constrained together.

Moreover, in a sole in accordance with the present invention, also one or more channels open upward can be provided, and such channels are set for accumulating the sweat of the foot of a user, and at least one evacuation zone or opening can be provided in fluid communication with the plurality of channels and leading to outside the sole 1 for the evacuation of the sweat accumulated therein. The channels are actually recessed in the sheet 4.

The plurality of channels can comprise at least two main longitudinal channels extended at least partly in the direction from the back R to the front F of the sole 1 and at least two first transverse channels or terminal transverse channels at least partly extended substantially in the direction from one side S1 to the other S2 of the sole 1 and, if desired each intercepting or extended starting from one end or in proximity to one end of one of the two main longitudinal channels to one end or in proximity to one end of another of the two main longitudinal channels.

The main longitudinal channels are extended in such case at least partly in the direction from the back R to the front F of the sole 1, in the sense that they have at least one end closer to the front of the other and vice versa, but they are not necessarily rectilinear with extension parallel to the back R-front F direction, but they could also be entirely or partly curved or tilted with respect to the back R-front F direction.

The plurality of channels also includes at least two second transverse channels or intermediate transverse channels extended substantially in the direction from one side of the sole 1 to the other and, if desired, each intercepting or extended between two or more main longitudinal channels, in particular starting from an intermediate portion or section of one of the two main longitudinal channels to an intermediate portion or section of another of the two main longitudinal channels.

The transverse channels are extended at least partly in the direction from one side of the sole to the other, in the sense that they have at least one end closer to one side of the other and vice versa, but they are not necessarily rectilinear with extension parallel to the direction from one side to the other, but they could also be entirely or partly curved or tilted with respect to the direction from one side to the other.

If also a third main longitudinal channel is provided, then the transverse channels preferably cross or intersect such channel in the passage from a first main longitudinal channel to another or second main longitudinal channel.

Preferably, the channels are communicating with each other so as to constitute a structure with islands or projections of the top component, which are delimited and separated from each other by the channels.

On such matter, all the channels, if provided, are in fluid communication with each other so as to constitute a structure with islands or projections separated from each other by the channels.

With reference to such aspect, the channels can all be in fluid communication with each other, so as to belong to a single group of channels or two or more groups of channels are provided, with the channels of each group all being in fluid communication with each other, but not in fluid communication with the channels of the other groups. At least one zone or an evacuation opening is provided for each group of channels, i.e. the sole comprises or delimits at least one evacuation opening in fluid communication with each group. Due to such expedient, the sweat percolated or collected in the channels can flow or run during the performance of the sport activity into the group or groups of channels up to the evacuation opening(s).

The channels can have constant or variable width and height, and can for example have U or V section or have another suitable configuration.

Relative to the or to each evacuation opening, this can be in fluid communication with the channels and is delimited at the back R or at the shoe waist or at the front F of the sole 1.

Advantageously, at least two openings are provided, each leading to a respective side S1, S2 of the sole 1. More particularly, at least one opening is provided, leading to a lateral side of the sole 1 and at least one opening leading to a medial side of the sole 1.

The sole 1 can also be provided with at least one filtering membrane to close or better yet cover an opening or a respective opening.

Also forming the object of the present invention is a shoe comprising a sole as indicated above and an upper constrained to the sole.

As can be verified, due to a sole according to the present invention it is possible to obtain an optimal forward thrust for a respective user, due to the shape of the protuberances and, if provided, of the ribs, which during a first step would be compressed by a user, while during a subsequent step would return a forward thrust force to the user himself/herself.

In addition, the configuration of the protuberances is such to be ergonomically adapted to the foot of each user, thus ensuring comfort and efficiency.

A sole in accordance with the present invention is also more easily adapted to different anatomies, since it is crushed as a function of the pressure, i.e. it is in fact self-modeling.

On such matter, if the protuberances at the front or at the shoe waist of the sole each comprise, in the direction from the interior or medial part to the exterior or lateral part of the sole, a first curved section and a second curved section then the front part of the sole follows the progression of the metatarsal heads of a foot of a user and ensures the flexibility by accompanying the foot during rolling.

It is then possible to have an external element made of one material and an insert made of a material different from that of the external element, so that the sole could be made of a single piece or of two or more pieces.

Channels could also be provided for, at which there would be a passage of sweat.

The channels would also allow implementing the elasticity of the sole.

Modifications and variations of the invention are possible within the protective scope defined by the claims.

What is claimed is:

1. A sole for a shoe comprising:

a main body having a lower layer delimiting a surface, and an upper layer, wherein said upper layer comprises a plurality of protuberances projecting upward, said plurality of protuberances comprising a constraining base and a free end, wherein each free end is closer to a back of the sole with respect to the relative constraining base, wherein in rest, said plurality of protuberances are tilted with respect to the vertical, both in a lateral section plane defined from one side to the other of the sole and in a longitudinal section plane defined from front to back of the sole, wherein adjacent protuberances define a transverse channel there between, wherein said protuberances are elastically pliable in a manner such that by applying pressure on said protuberances each of said protuberances is bent such that the respective free end bends toward the adjacent protuberance closer to the back of the sole, while when the pressure is released, said protuberances return to the initial position such that the respective free end returns in the direction of the front of the sole, releasing a forward thrust in the direction of the front of the sole, said plurality of protuberances being provided in at least one of a plurality of zones of the sole, the plurality of zones being defined as comprising a first zone disposed close to the front of the sole and distal from the back of the sole, a second zone disposed close to the back of the sole and distal from the front of the sole, and a third zone disposed in a middle portion of the sole between said first zone and said second zone, and a plurality of ribs at the surface set to come into contact with the ground during use, said plurality of ribs comprising an attachment base and a free tip, said free tips being disposed closer to the front of the sole with respect to the relative attachment base, wherein said ribs are elastically pliable in a manner such that by applying a pressure thereon, each rib is bent such that the respective free tip is bent toward an adjacent rib closer to the front of the sole so as to obtain a deformed condition, while when the pressure is released the ribs return to the initial position such that the respective free tip returns in the direction of the back of the sole releasing a forward thrust force.

2. The sole according to claim 1, wherein said protuberances comprise a rib configuration with a single external edge defining the free end.

3. The sole according to claim 1, wherein none of said protuberances comprise a free end closer to the front with respect to the relative constraining base.

4. The sole according to claim 1, wherein said protuberances have curved progression in a direction transverse to the longitudinal extension of the sole.

5. The sole according to claim 4, wherein said protuberances at the front of the sole each comprise, in the direction from a medial part to a lateral part of the sole, a first curved section defining a first concavity open towards the back of the sole and a second curved section defining a second concavity open towards the front of the sole.

6. The sole according to claim 4, wherein said protuberances at the back of the sole each comprise, in the direction from a medial side to a lateral side of the sole, only one third curved section defining a concavity open towards the back of the sole.

7. The sole according to claim 1, wherein said protuberances are tilted for the entire respective extension between constraining base and free end.

8. The sole according to claim 1, wherein top faces of the free ends of the protuberances are substantially aligned along a surface which from the front to the back has a third concavity directed upward and then a fourth concavity directed downward.

9. The sole according to claim 1, wherein said sole defines a recessed zone open upward and extended for 50-95% of the longitudinal extension of said sole and for 50-95% of the transverse extension of said sole, said protuberances being distributed for the entire longitudinal extension of said recessed zone and each extended from an edge portion of delimitation of said recessed zone on one side of the sole to another section of the edge portion of delimitation of said recessed zone on the other side of the sole.

10. The sole according to claim 1, wherein the sides of said protuberances are each constrained at a respective edge portion of said sole, such that the sides of said protuberances are substantially fixed in such edge portions.

11. The sole according to claim 1, comprising an insert and an external sole component defining a cavity, said insert being disposable in said cavity, said insert comprising said sheet and said protuberances.

12. The sole according to claim 11, wherein at least one through window is provided in said external sole component and wherein said sole comprises at least one component for filling the at least one window, said at least one fill component comprising a plate section from which at least one block is extended for filling the at least one window.

13. The sole according to claim 1, comprising one or more channels open upward, such channels being set for accumulating the sweat of a user's foot as well as at least one evacuation zone or opening in fluid communication with the plurality of channels and leading to outside the sole for the evacuation of the sweat accumulated therein.

14. The sole according to claim 1, further comprising an upper constrained to said sole.

15. A sole for a shoe, comprising:

a main body having a lower layer and an upper layer, said lower layer delimiting a surface set to come into contact with the ground during use, wherein said upper layer comprises a plurality of protuberances projecting upward, each of said plurality of protuberances comprising a trim tilted with respect to the vertical and lateral and further comprising a constraining base and a free end, wherein each of said free end is closer to a back of the sole with respect to the corresponding constraining base, and wherein said protuberances are elastically pliable in a manner such that by applying pressure on said protuberances each of said protuberances is bent such that the respective free end approaches an adjacent protuberance closer to the back of the sole and to a lateral side of the sole, while when the pressure is released, said protuberances return to an initial position such that the respective free end returns in the direction of a front of the sole and an opposed lateral side of the sole, releasing a forward thrust in the direction of the front of the sole and releasing a lateral thrust in the direction of the opposed lateral side of the sole.

16. The sole according to claim 15 wherein said lower layer comprises a plurality of ribs set to come into contact with the ground during use, said plurality of ribs comprising an attachment base and a free tip, said free tips being disposed closer to the front of the sole with respect to the relative attachment base.

17. The sole according to claim 16 wherein said plurality of ribs are elastically pliable in a manner such that by applying a pressure thereon, each rib is bent such that the respective free tip approaches an adjacent rib closer to the front of the sole so as to obtain a deformed condition, while when the pressure is released the ribs return to the initial position such that the respective free tip returns in the direction of the back of the sole releasing a forward thrust force.

* * * * *